United States Patent [19]

Lecerf et al.

[11] Patent Number: 4,930,952

[45] Date of Patent: Jun. 5, 1990

[54] GLASSES FRAME CARRIER FOR A REPRODUCING MACHINE

[75] Inventors: Michel J. M. Lecerf, La Saussaye; Raynald M. G. Longuet, Le Gros Theil, both of France

[73] Assignee: Briot International, Elbeuf, France

[21] Appl. No.: 336,240

[22] Filed: Apr. 11, 1989

[30] Foreign Application Priority Data

Apr. 14, 1988 [FR] France ..... 88 04931

[51] Int. Cl.[5] ..... B23Q 35/46

[52] U.S. Cl. ..... 409/130; 51/284 E; 269/108; 408/108; 409/219

[58] Field of Search ..... 51/284 E; 409/130, 219; 269/45, 108, 109, 111, 254 CS, 269, 270, 909; 408/108

[56] References Cited

U.S. PATENT DOCUMENTS

| | | | |
|---|---|---|---|
| 625,007 | 5/1899 | Wollman | 269/45 |
| 633,657 | 9/1899 | Muller | 269/270 X |
| 746,422 | 12/1903 | Webster | 269/45 |
| 3,527,454 | 9/1970 | Humm | 269/45 |
| 3,555,739 | 1/1971 | Novak | 51/284 E X |
| 3,610,612 | 10/1971 | Day | 269/109 |
| 3,786,600 | 1/1974 | Bloxsom | 51/284 E X |

FOREIGN PATENT DOCUMENTS

| | | | |
|---|---|---|---|
| 457013 | 2/1928 | Fed. Rep. of Germany | 269/108 |

*Primary Examiner*—Z. R. Bilinsky
*Attorney, Agent, or Firm*—Martin Smolowitz

[57] ABSTRACT

A glasses frame carrier for a reproducing machine, of the type comprising a base plate (1), two parallel strips (8, 9) slidably mounted on the base plate are relatively movable toward and away from each other, and a device for centering the glasses frame between the two strips. The strips are respectively fixed to opposed parallel portions of a cable (16) forming a loop around two spaced-apart pulleys, one pulley (14) constituting a cable-driving element (16) and including a braking device (21, 23, 24) which is adjustable and constituted by an elastic element (23) which biases the pulley (14) in contact with a friction element (21).

8 Claims, 2 Drawing Sheets

GLASSES FRAME CARRIER FOR A REPRODUCING MACHINE

BACKGROUND OF THE INVENTION

The present invention relates to a glasses frame carrier for a reproducing machine, termed copier, capable of machining a template or ophthalmic lens under the control of a device comprising a follower which recognizes the inside contour of the rims of a frame for eye glasses.

It is known that the positioning of an eye glasses frame on the copying or reproducing machine must be extremely precise, so that the template or the ophthalmic glass is perfectly centered relative to the rim of the frame.

Various devices are already known for the controlled positioning of a frame of eye glasses on a reproducing machine. The most common of these devices comprise a base plate for supporting the frame and on which two parallel strips are mounted to be relatively movable toward and away from each other, and means for immobilizing the strips in a chosen position. A frame for eye glasses is disposed and gripped between the strips which are then immobilized, and the frame and strips assembly is then placed on the machine in a position determined by complementary means provided on said plate and the machine.

In this device, the frame must be exactly immobilized between the strips, without clearance but without deformation. The positioning systems known up to the present time are unsatisfactory in this respect.

Indeed, with a system which blocks the frame by a mechanical clamping of the strips, when the latter have been brought in contact with the frame, there is always a danger of a displacement occurring, which results in an adverse clearance between the frame and the strips and consequently an imperfect precision in the reproducing operation.

In another known system, the strips are biased toward each other by elastic means, i.e. a spring whose degree of tension is a function of the dimension of the glasses. While the force exerted by the spring may be capable of providing a roughly satisfactory gripping with frames of average dimensions, this gripping may be insufficient with a small frame so that there is play, or the gripping may be excessive with a large frame and be liable to deform the latter.

SUMMARY OF THE INVENTION

An object of the invention is to overcome these drawbacks of known frame positioning devices by providing a glasses frame carrier for a copying machine comprising an improved system for immobilizing the two parallel strips.

The invention therefore provides a glasses frame carrier for a reproducing machine of the type comprising a base plate, so as two parallel strips slidably mounted on said plate to be relatively movable toward and away from each other, and means for centering the glasses frame between said strips, wherein the strips are respectively fixed on opposed parallel portions of a cable forming a loop around two spaced-apart pulleys, one of said pulleys constituting means for driving the cable and including a braking means.

According to another feature of the invention, said braking means are adjustable and preferably include an elastic element which biases the pulley axially in contact with a friction element.

The following description, with reference to the accompanying drawings given as nonlimitative examples, will explain how the present invention can be carried out.

DESCRIPTION OF THE PREFERRED EMBODIMENTS

Figure 2:
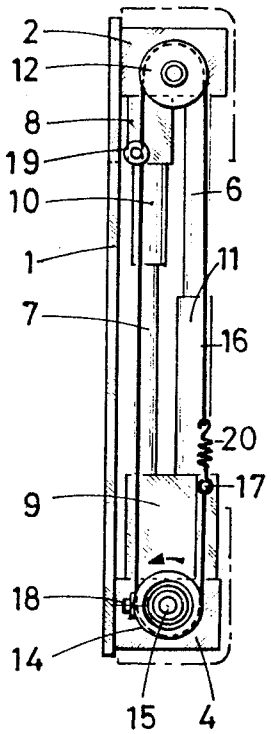
FIG. 2 is an end elevational view of the frame carrier system for connecting and driving the two parallel strips.
Figure 1:
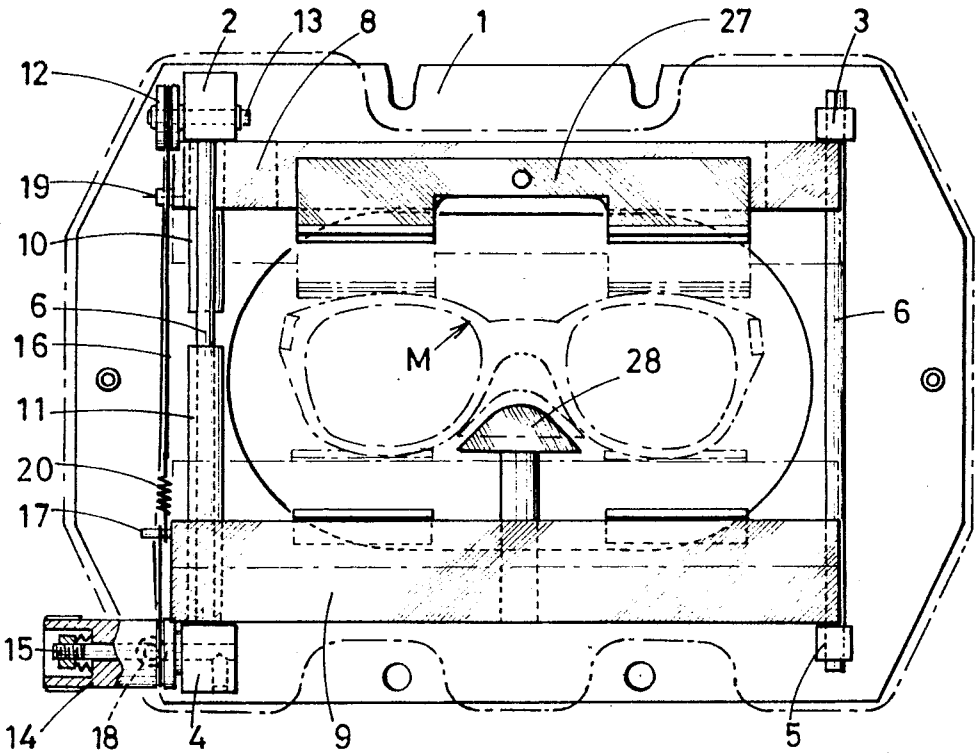
FIG. 1 is a plan view of a glasses frame carrier system according to the invention.

With reference first of all to FIG. 1, the frame carrier according to the invention comprises, in the known manner, a base plate 1 including four vertical supports 2, 3, 4, 5 attached to the base plate and located in the corners of a rectangle. Two parallel bars 6, 7 interconnect the supports 2, 4 and the supports 3, 5 respectively, on the smaller sides of the rectangle. The bars 6 and 7 are fixed on their respective vertical supports at different heights in a vertical plane perpendicular to the plate 1, as shown in FIG. 2.

A first strip 8 is slidably mounted on the two parallel bars 7 to move between the supports 2, 3 and 4, 5, and the supports a second strip 9 is slidably mounted on the two parallel bars 6.

In order to ensure a smooth sliding of the strips 8, 9 on the bars 6, 7, each strip may include a tubular boss 10, 11 respectively, surrounding one of the bars 6, 7 and constituting an abutment for the opposite strip.

According to the invention, the first pulley 12 is freely rotatively mounted on the vertical support 2 by means of a shaft 13, and a second pulley 14 is rotatively mounted on the vertical support 4 opposite the support 2, by means of a shaft 15. A cable 16 interconnects the pulleys 12, 14 and the strips 8, 9 in the following manner: a first end of the cable 16 is secured to a pin 17 mounted on the strip 9, the cable 16 then passes around the pulley 14 on which it is fixed by a screw 18, then extends onto the strip 8 on which it is fixed by a screw 19, and then passes around the pulley 12 and returns to the pin 17 to which the opposite end of the cable is connected through a spring 20 whose sole function is to provide a constant tension of the cable 16.

Figure 3:
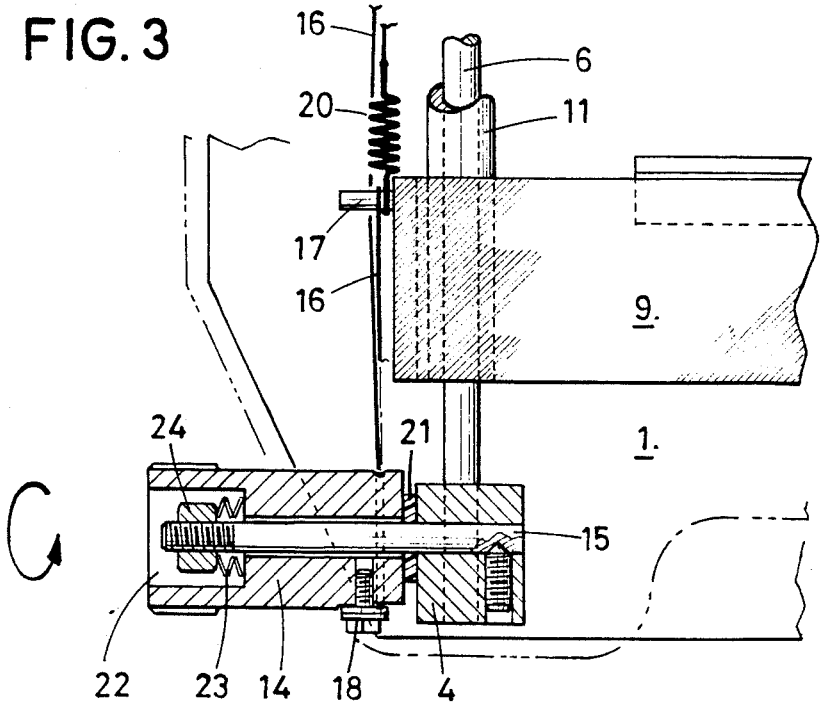
FIG. 3 is a partial enlarged view of the pulley constituting the strip driving means and its braking means, some parts of which are shown in section.

According to one feature of the invention, the shaft 15 of the vertical pulley 14 is fixed in the support 4 and the pulley 14 is formed by a cylinder rotatable about said shaft 15 and constituting a control knob, as shown more clearly by FIG. 3.

A Nylon washer 21 is interposed between the support 4 and the adjacent end of the cylinder or pulley 14. The latter has at its opposite end a counterbore 22, into which extends the screw-threaded end portion of the fixed shaft 15.

A spring 23 of the Belleville type is disposed in the counterbore 22 around the shaft 15, and is maintained under compression by a nut 24.

With this arrangement, when the cylinder constituting the pulley 14 is driven manually in rotation in opposition to the braking action provided by the clamping of the washer 21 between the pulley 14 and the support 1, the cable 16 drives the strips 8 and 9 toward each other or away from each other, depending on the direction of rotation of pulley 14.

This braking action is adjusted by means of the nut 24 in such a manner as to permit an easy manual driving, but also to create a sufficient resistance to maintain a frame M between the strips 8, 9 without play therebetween.

Figure 4:
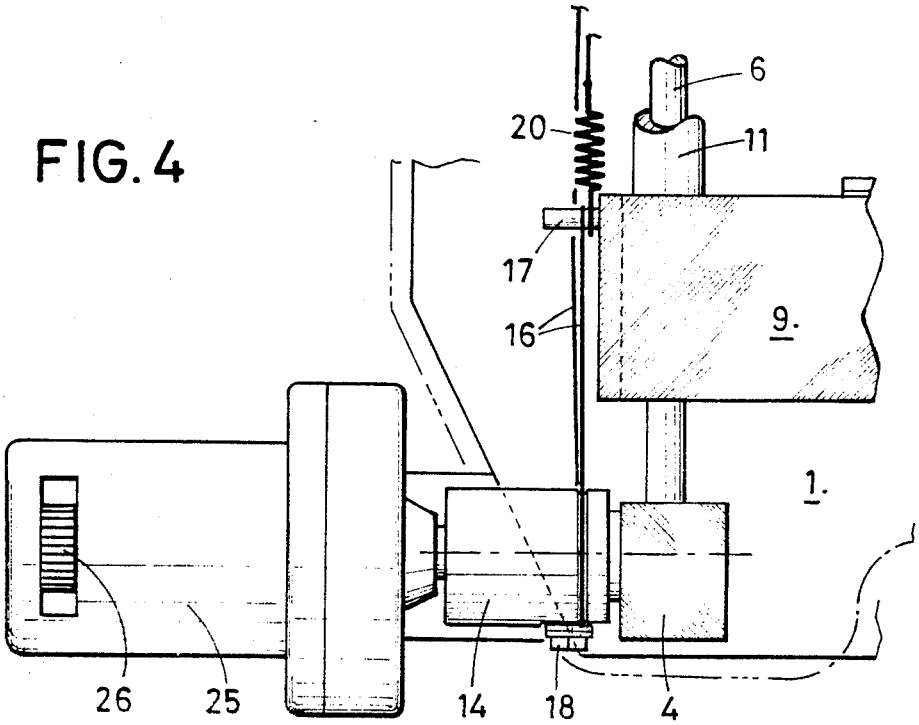
FIG. 4 is a view similar to FIG. 3 of a variant arrangement comprising a driving motor for the pulley.

In a variant arrangement shown in FIG. 4, the pulley 14 is driven by a motor-speed reducer unit 25 of known type including a forward-reverse-stop switch 26.

Advantageously, and in the known manner, the glasses frame carrier according to the invention may include a pivotal support 27 pivotally mounted on the strip 8 (or 9) and a centering foot 28 fixed to the strip 9 (or 8).

We claim:

1. Glasses frame carrier for a reproducing machine, which carrier comprises a base plate including four supports located at corners of a rectangle, two parallel strips each slidably mounted on two of said supports, said strips being relatively movable selectively toward and away from each other, and means for centering and supporting a glasses frame between said two parallel strips, said strips being respectively fixed to means comprising a cable having opposed parallel portions and to which portions said strips are each fixed, two spaced-apart pulleys each rotatably connected to said supports, said cable forming a loop around said pulleys, one of said pulleys constituting cable-driving means and one of said pulleys including braking means.

2. Glasses frame carrier according to claim 1, wherein the pulley constituting said cable-driving means is the pulley including said braking means.

3. Glasses frame carrier according to claim 2, wherein said braking means includes a friction element and an elastic element and is adjustable, said elastic element biasing the respective pulley axially in contact with said friction element.

4. Glasses frame carrier according to claim 1, comprising parallel superimposed bars fixed on said supports carrying said bars, said strips being slidably mounted on said bars, and said pulleys being mounted on two opposed supports of said base plate.

5. Glasses frame carrier according to claim 4, wherein said cable is fixed to a pin respectively connected to said strips and is fixed on said one of said pulleys constituting said cable-driving means.

6. Glasses frame carrier according to claim 3, comprising superimposed bars, fixed to said base plate carrying said bars, a shaft fixed to one of said supports and having a screw-threaded end portion, and a nut screw-threadedly engaged on said screw-threaded end portion of said shaft, said strips being slidably mounted on said bars, said pulleys being mounted on two opposed supports of said supports, said one of said pulleys constituting cable-driving means being a cylinder constituting a control knob rotatively mounted on said shaft, said friction element being a Nylon washer interposed between said cylinder and said one of said supports, and said elastic element comprising at least one Belleville washer disposed on said shaft between an opposed end of said cylinder and said nut.

7. Glasses frame carrier according to claim 1, comprising a motor-speed reducer unit drivingly connected to said one of said pulleys constituting cable-driving means.

8. Glasses frame carrier for a reproducing machine, which carrier comprises:

a base plate including four vertical supports located at corners of a rectangle;

two parallel strips each slidably mounted on two superimposed parallel bars interconnecting two of said supports on said base plate, said strips being relatively movable on said bars selectively toward and away from each other; and means for centering and supporting a glasses frame between said two movable parallel strips, said parallel strips being respectively fixed to means comprising a cable having opposed parallel portions and to which portions said strips are each fixed, two spaced-apart pulleys each rotatably connected to a support and to said base plate, said cable forming a loop around said pulleys and being fixed to one of said pulleys constituting cable-driving means and one of said pulleys fixed to each of said parallel slidable strips, one of said pulleys including braking means.

* * * * *